US007980224B2

(12) United States Patent
Lewis et al.

(10) Patent No.: US 7,980,224 B2
(45) Date of Patent: Jul. 19, 2011

(54) TWO WIRE INTENSIFIED COMMON RAIL FUEL SYSTEM

(75) Inventors: Stephen R. Lewis, Chillicothe, IL (US); Bradley E. Bartley, Pekin, IL (US); Avinash R. Manubolu, Edwards, IL (US); Shriprasad G. Lakhapati, Peoria, IL (US); Dianqi Fang, Dunlap, IL (US); Michael Gerstner, Peoria, IL (US); Christopher D. Hanson, Washington, IL (US); Jeffrey M. Mullinix, Bloomington, IL (US)

(73) Assignee: Caterpillar Inc., Peoria, IL (US)

( * ) Notice: Subject to any disclaimer, the term of this patent is extended or adjusted under 35 U.S.C. 154(b) by 342 days.

(21) Appl. No.: 12/322,479

(22) Filed: Feb. 3, 2009

(65) Prior Publication Data

US 2009/0194072 A1 Aug. 6, 2009

Related U.S. Application Data

(60) Provisional application No. 61/063,724, filed on Feb. 5, 2008.

(51) Int. Cl.
*F02M 37/04* (2006.01)
*F02M 47/02* (2006.01)

(52) U.S. Cl. ..... 123/447; 123/510; 123/467; 239/96

(58) Field of Classification Search ..... 123/446, 123/447, 467, 506, 510–511; 239/88–96
See application file for complete search history.

(56) References Cited

U.S. PATENT DOCUMENTS 4,182,492 A * 1/1980 Albert et al. ..... 239/92
5,819,704 A 10/1998 Tarr et al.
6,082,332 A * 7/2000 Hefler et al. ..... 123/446
6,220,528 B1 4/2001 Cooke et al.
6,260,775 B1 7/2001 Lambert et al.
6,595,189 B2 * 7/2003 Coldren et al. ..... 123/467
6,644,282 B2 11/2003 Schwarz
6,776,138 B2 8/2004 Mahr et al.
6,830,202 B2 12/2004 Coldren
7,107,966 B2 9/2006 Tanabe et al.
7,108,200 B2 * 9/2006 Sturman ..... 239/88
7,182,068 B1 * 2/2007 Sturman et al. ..... 123/446
7,188,782 B2 3/2007 Magel
7,228,845 B2 * 6/2007 Yamamoto ..... 123/446
7,316,361 B2 * 1/2008 Magel ..... 239/89
7,398,765 B2 * 7/2008 Yamamoto ..... 123/467
2002/0053340 A1 5/2002 Lei
2003/0089802 A1 5/2003 Mahr et al.
2003/0127539 A1 7/2003 Braun et al.
2003/0131824 A1 7/2003 Mahr et al.
2003/0178508 A1 9/2003 Coldren
(Continued)

*Primary Examiner* — Thomas N Moulis
(74) *Attorney, Agent, or Firm* — Liell & McNeil

(57) ABSTRACT

A fuel system includes a plurality of fuel injectors fluidly connected to a common rail. Each of the fuel injectors has at least one body component and includes an intensifier control valve for controlling movement of an intensifier piston, a needle control valve for controlling movement of a needle valve member, and exactly one electrical actuator coupled with the intensifier control valve and the needle control valve via a coupling linkage. The intensifier control valve and the needle control valve each include a valve member that is movable with respect to a valve seat. The electrical actuator includes an intermediate position during which the valve member of one of the intensifier control valve and the needle control valve is in contact with the respective valve seat, and the valve member of the other of the intensifier control valve and the needle control valve is out of contact with the respective valve seat.

20 Claims, 5 Drawing Sheets

U.S. PATENT DOCUMENTS

2004/0195385 A1 10/2004 Lawrence et al.
2005/0077378 A1* 4/2005 Kropp et al. ..... 239/88
2005/0172935 A1* 8/2005 Magel et al. ..... 123/446
2006/0162695 A1 7/2006 Shibata
2006/0289670 A1* 12/2006 Beilharz et al. ..... 239/88
2008/0047527 A1 2/2008 Sun et al.

* cited by examiner

TWO WIRE INTENSIFIED COMMON RAIL FUEL SYSTEM

CROSS-REFERENCE TO RELATED PATENT APPLICATIONS

This application claims priority to provisional U.S. Patent Application Ser. No. 61/063,724, filed Feb. 5, 2008, entitled "TWO WIRE INTENSIFIED COMMON RAIL FUEL SYSTEM," the disclosure of which is hereby incorporated herein by reference.

TECHNICAL FIELD

The present disclosure relates generally to electronically controlled fuel systems for engines, and more particularly to a two wire intensified common rail fuel system.

BACKGROUND

Engineers are constantly seeking improved performance and expanded capabilities for fuel systems, especially for those related to compression ignition engines. Numerous references show four wire systems that include first and second electrical actuators associated with each fuel injector. One of the electrical actuators typically relates to pressure control, and the other of the two electrical actuators is typically associated with controlling the needle valve member to open and close the nozzle outlet. In some common rail four wire systems, the first electrical actuator may be associated with controlling an intensifier piston to perform injections at an elevated pressure, which is greater than a pressure maintained in the common rail. The second electrical actuator relieves and applies hydraulic pressure on a needle valve member to open and close a nozzle outlet independent of controlling the intensifier. An example of such a system has been known as the Bosch APCRS fuel system. Such a system can inject fuel at a high pressure directly from the rail via the utilization of the electrical actuator for needle control alone, or inject at an even higher intensified pressure by utilizing both the needle valve actuator and a second electrical actuator associated with intensifier control.

An additional example of an intensified common rail fuel system is provided in U.S. Patent Application Publication No. 2003/0089802. Specifically, the cited reference teaches a fuel injector having a first directional control valve for triggering an injector and a second directional control valve for actuating a pressure intensifier. Both of the first and second directional control valves are actuated using a single actuating element that is coupled with the directional control valves via a shared hydraulic coupling chamber. Each directional control valve includes a neutral position and two switched positions, which may be selected via actuation of the single actuating element. Although fuel systems of this type have achieved expanded capabilities, there remains room for improving performance and reducing complexity.

The present disclosure is directed toward one or more of the problems set forth above including improving performance and/or reducing complexity in electronically controlled fuel systems.

SUMMARY OF THE DISCLOSURE

In one aspect, a fuel system includes a plurality of fuel injectors fluidly connected to a common rail. Each of the fuel injectors has at least one body component and includes an intensifier control valve for controlling movement of an intensifier piston, a needle control valve for controlling movement of a needle valve member, and exactly one electrical actuator coupled with the intensifier control valve and the needle control valve via a coupling linkage. The intensifier control valve and the needle control valve each include a valve member that is movable with respect to a valve seat. The electrical actuator includes an intermediate position during which the valve member of one of the intensifier control valve and the needle control valve is in contact with the respective valve seat, and the valve member of the other of the intensifier control valve and the needle control valve is out of contact with the respective valve seat.

In another aspect, a method of operating a fuel injector of a fuel system includes injecting fuel at an unintensified pressure level and injecting fuel at an intensified pressure level. Fuel is injected at an unintensified pressure level, at least in part, by energizing a piezo electrical actuator at a low voltage level, moving the piezo electrical actuator to an intermediate position, moving a valve member of a needle control valve out of contact with a valve seat of the needle control valve, and maintaining a valve member of an intensifier control valve in contact with a valve seat of the intensifier control valve. Fuel is injected at an intensified pressure level, at least in part, by energizing the piezo electrical actuator at a high voltage level, moving the piezo electrical actuator to a second position, moving the valve member of the needle control valve out of contact with the valve seat of the needle control valve, and moving the valve member of the intensifier control valve out of contact with the valve seat of the intensifier control valve.

In yet another aspect, a fuel injector for a fuel system includes a fuel injector body. The fuel injector body houses an intensifier control valve for controlling movement of an intensifier piston, a needle control valve for controlling movement of a needle valve member, and exactly one electrical actuator coupled with the intensifier control valve and the needle control valve via a coupling linkage. The intensifier control valve and the needle control valve each include a valve member that is movable with respect to a valve seat. The electrical actuator includes an intermediate position during which the valve member of one of the intensifier control valve and the needle control valve is in contact with the respective valve seat, and the valve member of the other of the intensifier control valve and the needle control valve is out of contact with the respective valve seat.

DETAILED DESCRIPTION

Figure 1:
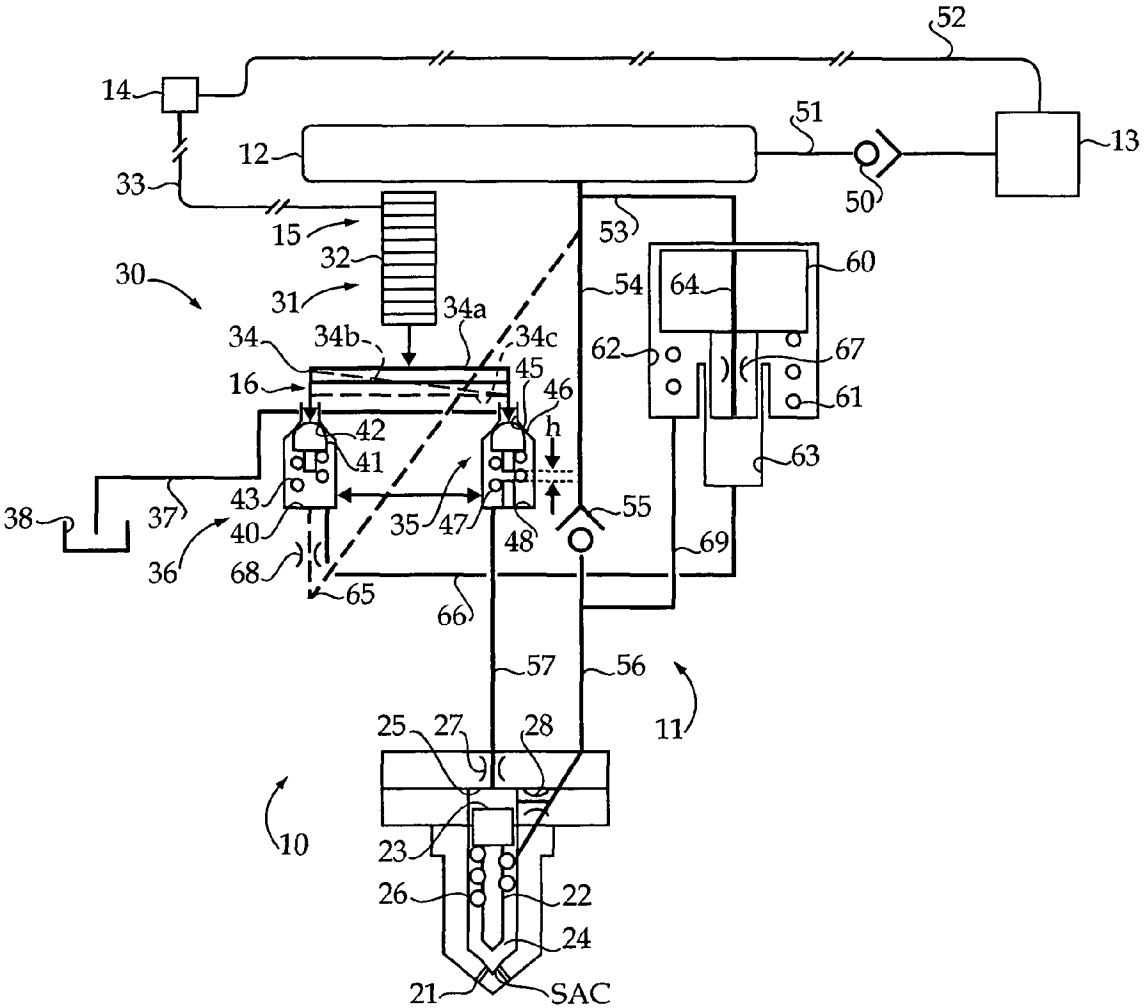
FIG. 1 is a schematic view of a fuel system according to one aspect of the present disclosure.

Referring now primarily to FIG. 1, but also FIGS. 2-5, a fuel system 10 typically includes a plurality of individual fuel injectors 11 (only one shown) that are positioned for direct injection of fuel into respective engine cylinders (not shown). For instance, the engine may be a compression ignition engine. Fuel system 10 includes a common rail 12 that is pressurized to a relatively high pressure, such as that on the order of about 190 MPa, by a high pressure pump 13 that is controlled in its output to rail 12 by an electronic controller 14. Control signals are communicated from electronic controller 14 to high pressure pump 13 via a communication line 52. High pressure pump 13 fluidly supplies common rail 12 via a rail supply line 51, which may include a check valve 50.

Each fuel injector 11 may include one or more body components for housing the plurality of fluidly connected bodies described herein. According to the exemplary embodiment, each fuel injector 11 may include an injector body 20 (FIG. 2) made up of an injector stack of metallic components compressibly joined together in a known manner to define a variety of internal passages and chambers. Injector body 20 defines a nozzle outlet 21 that opens into the individual engine cylinder (not shown). A needle valve member 22 may be movable between a closed position and an open position, as shown, to block and allow injection spray, respectively. The forces on needle valve member 22 may include a biasing force from needle spring 26 that tends to bias needle valve member 22 toward a downward closed position, an upward opening hydraulic force on an opening hydraulic surface 24, and a hydraulic closing force acting on a closing hydraulic surface 23. Opening hydraulic surface 24 is exposed to fluid pressure in a needle supply passage 56, which may receive a fuel supply from common rail 12 via rail injection line 54, and the closing hydraulic surface 23 is exposed to fluid pressure in a needle control chamber 25. Control chamber 25 is fluidly connected to needle supply passage 56 via a small flow restriction orifice 28, and is also fluidly connected to a spring chamber 48 via a pressure communication passage 57, which includes a larger flow restriction orifice 27.

A control group 30 of fuel injector 11, which may or may not be housed within injector body 20, may include a single electrical actuator 15. According to the exemplary embodiment, the single electrical actuator 15 may include a piezo electrical actuator 31 having a piezo stack 32 that changes in length in response to control signals (voltage) received on communication line 33 from electronic controller 14. Communication line 33 includes only two wires connected to the only two electrical connections 33*a* and 33*b* associated with control group 30. Piezo electrical actuator 31 may interact with a needle control valve 35 and an intensifier control valve 36 via a coupling linkage 16, such as a shared bridge 34. Shared bridge 34 may include a plurality of orientations, such as, for example, a de-energized orientation 34*a* (solid lines), a pivoted orientation 34*b* (dashed line), and a double actuated orientation 34*c* (dashed line).

For example, when piezo electrical actuator 31 is de-energized, the shared bridge 34 may assume the de-energized orientation 34*a*, and both the needle control valve 35 and the intensifier control valve 36 may remain closed. When piezo electrical actuator 31 is energized at a low voltage level, shared bridge 34 may be moved to its pivoted orientation 34*b*. At the pivoted orientation 34*b* of the shared bridge 34, the needle control valve 35 may be moved to an open position, but the intensifier control valve 36 may remain closed. When piezo electrical actuator 31 is energized at a high voltage level, shared bridge 34 is in its double actuated orientation 34*c*, and both needle control valve 35 and intensifier control valve 36 may be opened. As should be appreciated, needle control valve 35 and intensifier control valve 36 may be opened to fluidly connect their respective spring chambers 48 and 40 to a tank 38 via a shared drain passage 37. As used herein, "opening" one of the control valves 35 and 36 may include pushing a valve member such that it is out of contact with a respective valve seat, while "closing" the control valves 35 and 36 may include moving, or maintaining, the valve member such that the valve member is in contact with the respective valve seat.

Intensifier control valve 36 may include a valve member 41 that is biased to close a valve seat 42 via a spring 43, which is located in spring chamber 40. When intensifier control valve 36 is opened, such as by pushing valve member 41 against a pre-load provided by spring 43, intensifier control chamber 63 becomes fluidly connected to drain line 37 via a fluid connection line 66 and spring chamber 40. Similarly, needle control valve 35 may include a valve member 46 biased to close a valve seat 45 by a spring 47, which is located in spring chamber 48. When needle control valve 35 is opened, by pushing the valve member 46 against a pre-load provided by spring 47, control chamber 25 becomes fluidly connected to drain line 37 via pressure communication passage 57 and spring chamber 48. As discussed below, the springs 43 and 47 may be provided with different pre-loads.

Figure 2:
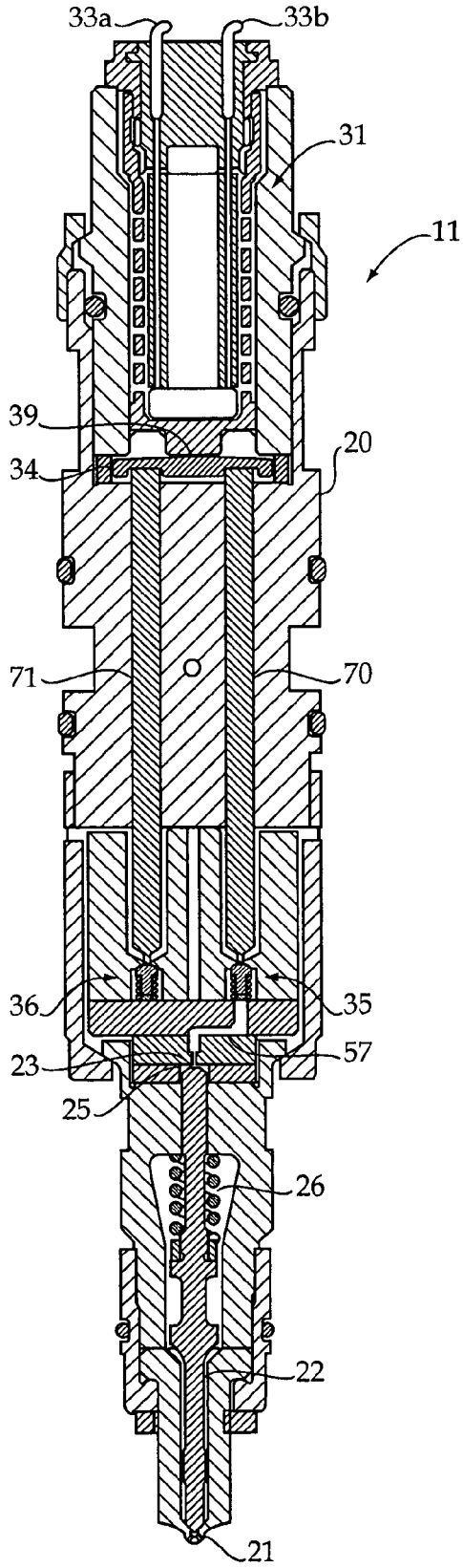
FIG. 2 is a sectioned view through a fuel injector for the fuel system of FIG. 1.
Figure 3:
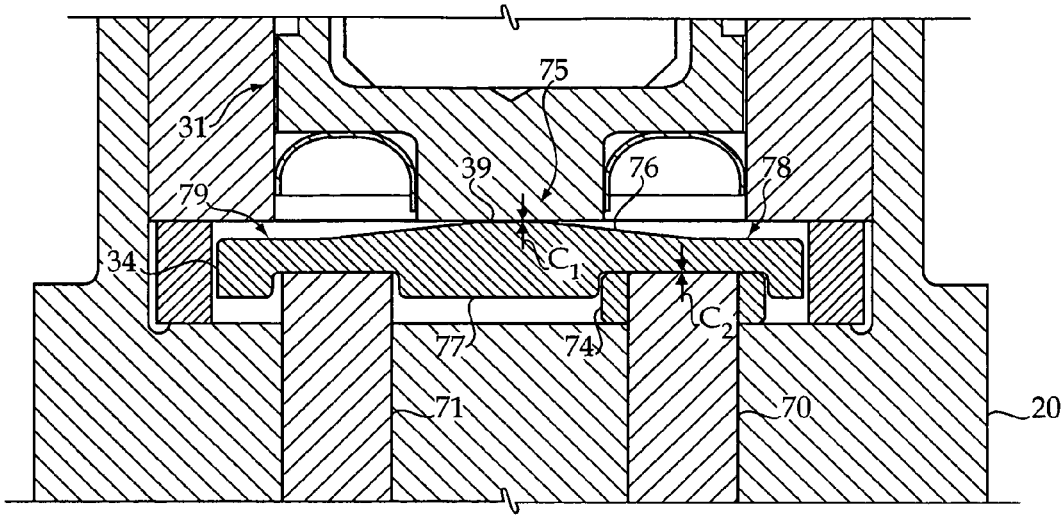
FIG. 3 is an enlarged sectioned view of the bridge region of the fuel injector of FIG. 2.
Figure 4:
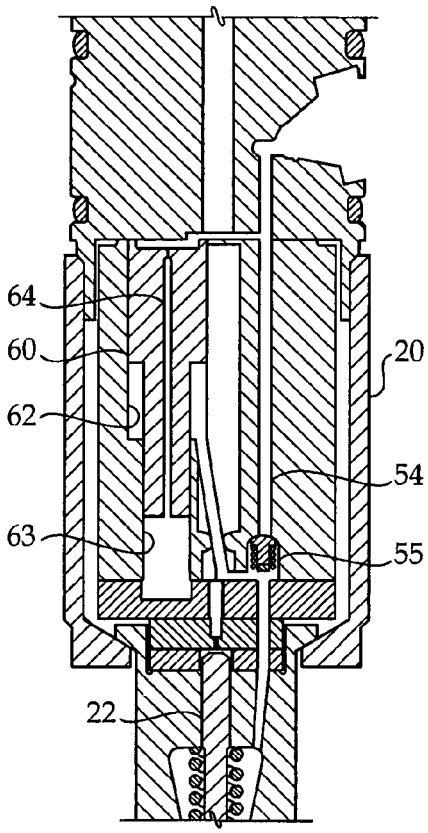
FIG. 4 is a different sectioned view through the fuel injector of FIG. 1 showing the intensifier features.
Figure 5:
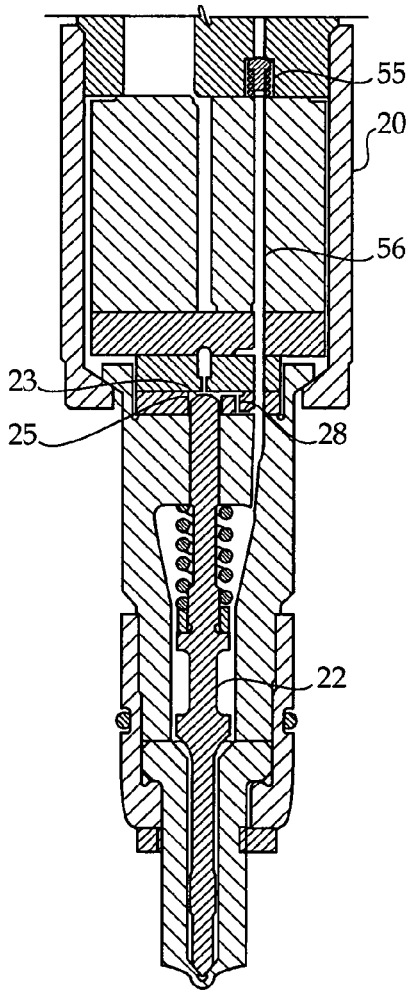
FIG. 5 is still another sectioned view through the fuel injector of FIG. 1 showing the needle control pressure features.

Control group 30 may be configured such that when a low voltage control signal is supplied to the piezo electrical actuator 31, the piezo electrical actuator 31 moves from a first position to an intermediate position and pushes on a central portion 75 of a first 76 of two opposing surfaces 76 and 77 of the shared bridge 34 (FIG. 3). As a result, the shared bridge 34 pivots to only open needle control valve 35, by pushing valve member 46 with a first end 78 of the second opposing surface 77. Valve member 46, however, may be limited in its travel distance to a travel distance h. The shared bridge 34 may be configured to interact with piezo electrical actuator 31 such that the shared bridge 34 pivots about a fulcrum 39, such as an offset fulcrum, when opening needle control valve 35 while leaving intensifier control valve 36 closed. According to one embodiment, valve member 46 may be limited in its travel distance movement via a stop 74, as shown in FIGS. 2 and 3. As should be appreciated, the movement force from piezo electrical actuator 31 may be transmitted to the respective needle control valve 35 or intensifier control valve 36 via respective rods 70 and 71.

In response to a higher voltage control signal, the piezo electrical actuator 31 may be moved to a second position and the shared bridge 34 may be further displaced. Specifically, the shared bridge 34 may be rotated back toward and beyond its original orientation to assume the double actuated orientation 34*c*, thus simultaneously opening the needle control valve 35, as described above, and the intensifier control valve 36, by pushing the valve member 41 with a second end 79 of the second opposing surface 77. The shared bridge 34 may be configured to have a relatively small clearance $c_1$ between the fulcrum 39 and piezo electrical actuator 31. In addition, the shared bridge 34 may be configured to have a relatively larger clearance $c_2$ between shared bridge 34 and rod 70, as shown in FIG. 3. According to one specific example, clearance $c_1$ may be on the order of about 5 micrometers, and clearance $c_2$ may be on the order of about 25 micrometers. The clearances may correspond to a 50 micrometer movement by the piezo electrical actuator 31 in response to the low voltage control signal, thus moving valve member 46 about 20 micrometers.

Fuel injector 11 may also include an intensifier piston 60 having a top end fluidly connected to common rail 12 via an intensifier supply passage 53. The injector body 20 and intensifier piston 60 may define a control chamber 63 that is fluidly connected to spring chamber 40 of intensifier control valve 36 via fluid connection line 66. In addition, intensifier piston 60 and injector body 20 may define a fuel pressurization chamber 62 that is fluidly connected to needle supply passage 56 via an intensified pressure supply line 69. As shown, fuel system 10 may include a plurality of different pathways for refilling intensifier control chamber 63 between injection events in order to retract intensifier piston 60, with assistance of a return spring 61, for a subsequent intensified injection event. For instance, intensifier piston 60 may include an internal passageway 64 with a flow restriction 67 that fluidly connects control chamber 63 directly to intensifier supply line 53. In addition, fuel system 10 shows an alternate route that includes a refill line 65 fluidly connected to control chamber 63 via a flow restriction 68 in connection line 66 and spring chamber 40. The flow area through respective flow restriction 67 or 68 may be chosen as a tradeoff of how quickly the intensifier piston 60 can retract between injection events versus how much pressurized rail fuel is wasted toward tank 38 during an injection event.

INDUSTRIAL APPLICABILITY

The present disclosure may find potential application to fuel systems for any internal combustion engine, and especially for compression ignition engines. The present disclosure may be particularly applicable to two wire fuel systems that include only a single electrical actuator associated with each fuel injector. Although the fuel injector includes only a single actuator, the present disclosure may find applicability to advanced fuel systems with the ability to inject fuel at two different pressures while maintaining injection timing control at either pressure.

Figure 8A:
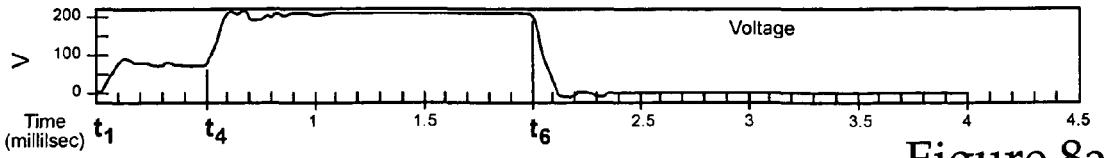
FIGS. 8*a*-8*h* are graphs of piezo actuator voltage, needle control valve position, intensifier control valve position, intensifier piston position, needle valve member position, SAC pressure, needle control chamber pressure and injection rate versus time for an example injection event according to the present disclosure.
Figure 8B:
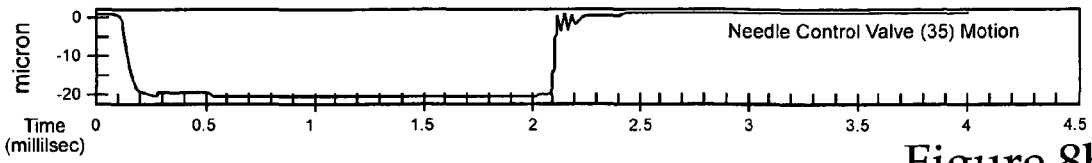
Figure 8C:
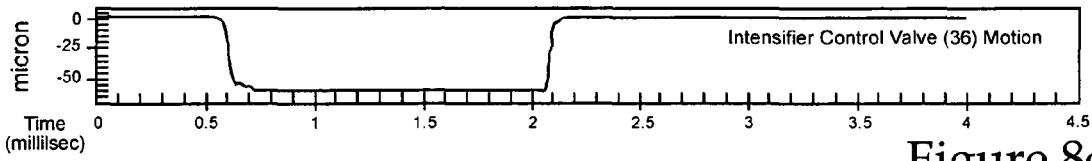
Figure 8D:
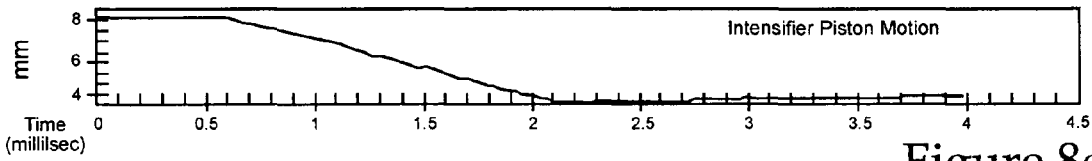
Figure 8E:
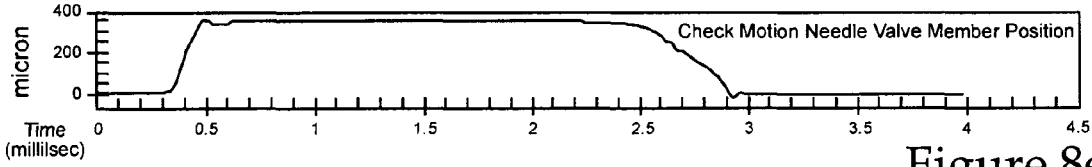
Figure 8F:
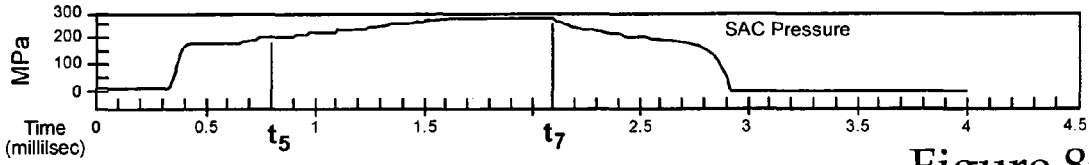
Figure 8G:
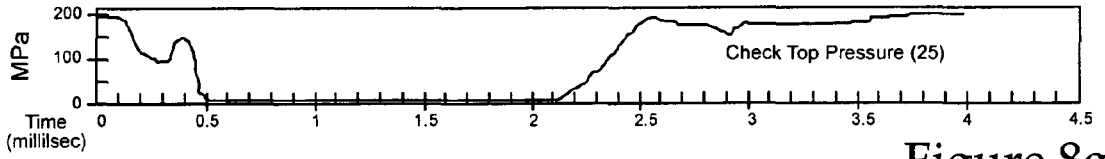
Figure 8H:
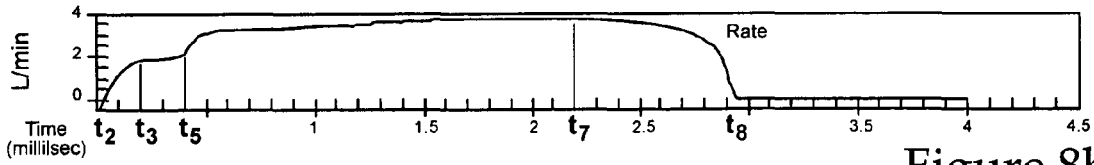

Referring also to the graphs of FIGS. 8*a*-*h*, an example of a fuel injection sequence is described in relation to key pressures and component positions within fuel injector 11. The FIG. 8*h* is shown both in an exaggerated form adjacent FIG. 1 and with other key graphs with FIGS. 8*a*-8*g*. Before time $t_1$, the piezo electrical actuator 31 is de-energized, thus assuming a first position or length. In the first position of the piezo electrical actuator 31, intensifier piston 60 is in its retracted position and needle valve member 22 is in its downward position to close nozzle outlet 21. Rail pressure prevails throughout the injector except for the SAC.

At time $t_1$, electronic controller 14 sends a low voltage control signal to piezo electrical actuator 31 via communication line 33, as per FIG. 8*a*. This causes the piezo electrical actuator 31 to move to an intermediate position or length, thus moving the shared bridge 34 to its pivoted state 34*b*. At the pivoted state 34*b* of the shared bridge, the needle control valve 35 may be opened, as per FIG. 8*b*, and the intensifier control valve 36 may remain closed. Opening the needle control valve 35 fluidly connects spring chamber 48 to tank 38 via drain line 37, causing pressure to drop in needle control chamber 25, as shown in FIG. 8*g*. When this is done, control chamber 25, which was previously at rail pressure, drops in pressure via the fluid connection provided by pressure communication passage 57. Pressure in needle control chamber 25 drops because the flow area through restriction 28 is smaller than the flow area through restriction 27, which, in turn, is smaller than the flow area past valve seat 45. Shortly after, at time $t_2$, the force acting on opening hydraulic surface 24 can then overcome spring 26 and the residual pressure force on closing hydraulic surface 23 to move needle valve member 22 toward an open position, as shown in FIG. 8*b*, to begin injection, as per FIG. 8*h*. As needle valve member 22 moves upward, the injection rate increases and levels out after time $t_3$.

At time $t_4$, a higher voltage control signal is supplied to piezo electrical actuator 31, as shown in FIG. 8*a*, thus moving the piezo electrical actuator 31 to a third position or length. When this occurs, the shared bridge 34 may assume its double actuated orientation 34*c* to also open intensifier control valve 36 (FIG. 8*c*) to allow fluid to evacuate from intensifier control chamber 63 to initiate motion of intensifier piston 60 (FIG. 8*d*). As intensifier piston 60 begins to move downward, the fuel in fuel pressurization chamber 62 is elevated and pushed toward needle supply passage 56 via intensified pressure line 69. When the pressure exceeds rail pressure, check valve 55 may close and the injection rate (FIG. 8*h*) and pressure (FIG. 8*f*) may jump to an intensified level, such as on the order of about 270 MPa between the times $t_5$ and $t_7$. Those skilled in the art will appreciate that the relationship between the elevated intensified pressure and the pressure in rail 12 are related to the area ratio associated with intensifier piston 60, and, in particular, the ratio of the top area to the area exposed to intensifier chamber 62.

At time $t_6$, the piezo electrical actuator 31 is de-energized, or returned to the first position, and shared bridge 34 returns to its de-energized orientation 34*a* to close both needle control valve 35 (FIG. 8*b*) and intensifier control valve 36 (FIG. 8*c*). This causes pressure within the fuel injector 11 to begin to drop (FIG. 8*f*) and the injection event to move toward an end point at time $t_8$ (FIG. 8*h*). At this point, fluid begins to flow into intensifier control chamber 63 through one or both of the refill lines 64 or 65 to retract intensifier piston 60 toward its retracted position for a subsequent injection event (FIG. 8*d* gradual slope up).

Those skilled in the art will appreciate that fuel injector 11 can be operated to inject only at the rail pressure level by sending the low voltage control signal, but not sending a higher voltage control signal to piezo electrical actuator 31. In addition, an injection event can avoid the boot shape associated with the fuel injection event previously described by immediately initiating an injection event by sending the higher voltage signal to piezo electrical actuator 31 to open both needle control valve 35 and intensifier control valve 36 nearly simultaneously. In addition, the end of an injection event can be altered by first dropping to the low voltage level, prior to completely de-energizing piezo electrical actuator 31, to potentially have a reduced injection rate prior to closing nozzle outlet 21. In addition, the structure described herein allows for split or multiple injections, such as a small pilot injection from the rail, a main injection event that may have a rate shape as per the injection event described above, followed by a small post injection event at rail pressure.

Figure 7:
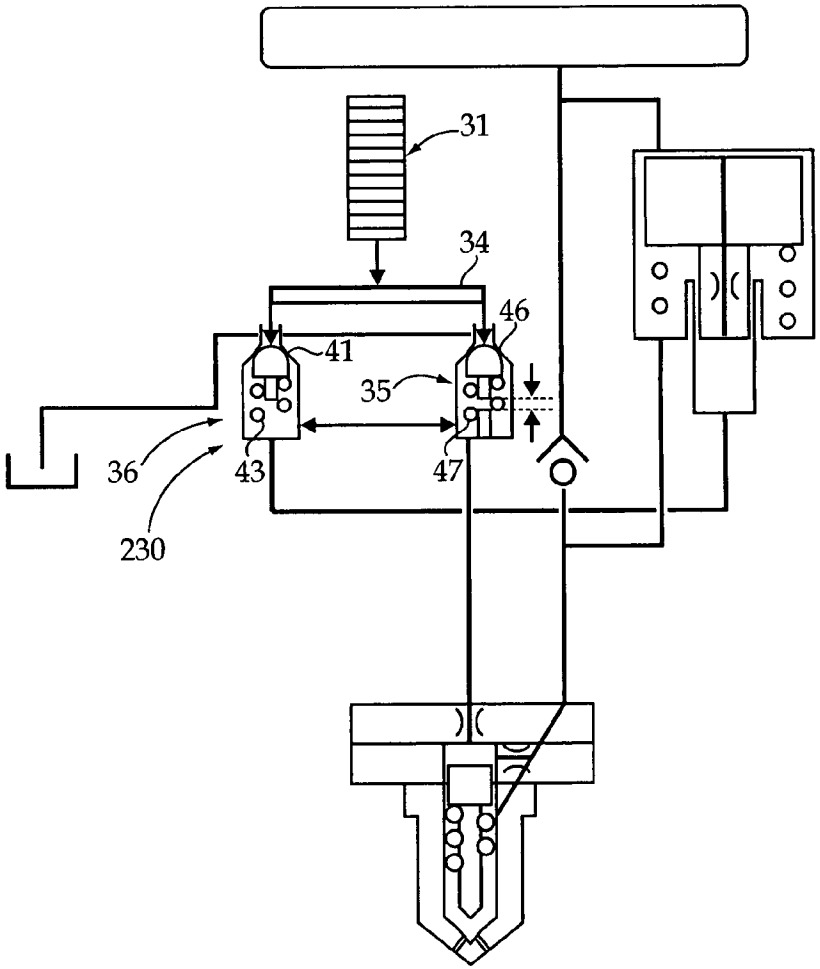
FIG. 7 is a fuel system schematic according to still another aspect of the present disclosure.

Although the embodiment of FIGS. 1-5 shows a single electrical actuator 15, such as a piezo electrical actuator 31, coupled to two control valves 35 and 36 via a shared bridge 34, other alternative construction strategies may be available. For instance, the biasing springs 47 and 43 in FIG. 1 may have roughly the same pre-load, but an alternative version of a control group 230, as shown in FIG. 7, shows the pivoting action of the bridge 34 accomplished in part via different pre-loads on the respective springs 47 and 43 for the two valves 35 and 36. For example, the spring 43 of the intensifier control valve 36 may have a greater pre-load than the spring 47 of the needle control valve 35. Specifically, the pre-loads may be selected such that only the valve member 46 of the needle control valve 35 is actuated in the intermediate position of the piezo electrical actuator 31, while the valve members 46 and 41 of both the needle control valve 35 and the intensifier control valve 36 are actuated in the second position of the piezo electrical actuator 31.

Figure 6:
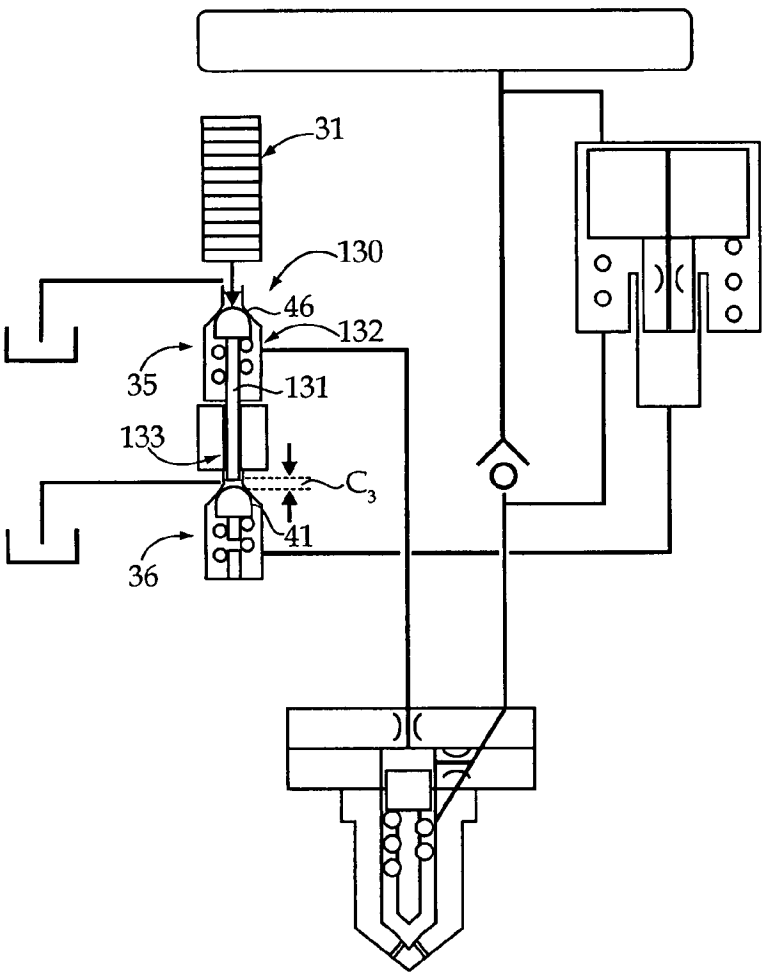
FIG. 6 is a fuel system schematic according to another aspect of the present disclosure.

In still another alternative, shown in an alternative version of a control group 130 of FIG. 6, the control valves 35 and 36 may be stacked such that energizing at a low level opens only the needle control valve 35, but energizing at a high voltage level pushes a connecting rod 131, having first and second ends 132 and 133, to open both the needle control valve 35 and the intensifier control valve 36. Specifically, to inject fuel at an unintensified pressure level, the valve member 46 of the needle control valve 35 may be pushed a first distance, not greater than a clearance $c_3$, with the piezo electrical actuator 31. To inject fuel at an intensified pressure level, the valve member 46 of the needle control valve 35 may be pushed a second distance, which is greater than the first distance, with the piezo electrical actuator 31. As a result, the valve member 41 of the intensifier control valve 36 may be pushed with the second end 133 of the connecting rod 131. Thus, a variety of coupling strategies, including mechanical and/or fluid coupling strategies, between the piezo electrical actuator 31 and the control valves 35 and 36 are contemplated.

The fuel system 10 of the present disclosure has the advantage of improving performance via the quick action of a piezo electric actuator 31 over similar systems that may use one or more solenoids. In addition, this performance improvement is accomplished without a significant sacrifice in injection control capabilities. For instance, what many similar systems accomplish with dual electrical actuators, the fuel system of the present disclosure accomplishes with only one electrical actuator, thus reducing complexity, part count, and potential electrical problems associated with four wire fuel systems by as much as a half or more.

It should be understood that the above description is intended for illustrative purposes only, and is not intended to limit the scope of the present disclosure in any way. Thus, those skilled in the art will appreciate that other aspects of the disclosure can be obtained from a study of the drawings, the disclosure and the appended claims.

What is claimed is:

1. A fuel system, comprising:

a plurality of fuel injectors fluidly connected to a common rail;

each of the fuel injectors having at least one body component and including an intensifier control valve for controlling movement of an intensifier piston, a needle control valve for controlling movement of a needle valve member, and exactly one electrical actuator coupled with the intensifier control valve and the needle control valve via a coupling linkage;

each of the intensifier control valve and the needle control valve including a valve member that is movable with respect to a valve seat;

the electrical actuator having an intermediate position during which the valve member of one of the intensifier control valve and the needle control valve is in contact with the respective valve seat, and the valve member of an other of the intensifier control valve and the needle control valve is out of contact with the respective valve seat.

2. The fuel system of claim 1, wherein the electrical actuator further includes a first position during which the valve member of the intensifier control valve is in contact with the valve seat of the intensifier control valve, and the valve member of the needle control valve is in contact with the valve seat of the needle control valve.

3. The fuel system of claim 2, wherein the electrical actuator further includes a second position during which the valve member of the intensifier control valve is out of contact with the valve seat of the intensifier control valve, and the valve member of the needle control valve is out of contact with the valve seat of the needle control valve.

4. The fuel system of claim 3, wherein, in the intermediate position of the electrical actuator, the valve member of the needle control valve is out of contact with the valve seat of the needle control valve, and the valve member of the intensifier control valve is in contact with the valve seat of the intensifier control valve.

5. The fuel system of claim 4, wherein the electrical actuator includes a piezo electrical actuator.

6. The fuel system of claim 5, wherein the coupling linkage includes a shared bridge having first and second opposing surfaces, a central portion of the first opposing surface being positioned for contact with the piezo electrical actuator, a first end of the second opposing surface being positioned for contact with the valve member of the needle control valve, and a second end of the second opposing surface being positioned for contact with the valve member of the intensifier control valve.

7. The fuel system of claim 6, wherein the valve member of the needle control valve is biased toward the valve seat of the needle control valve using a first spring, and the valve member of the intensifier control valve is biased toward the valve seat of the intensifier control valve using a second spring, the second spring having a greater pre-load than the first spring.

8. The fuel system of claim 5, wherein the coupling linkage includes a connecting rod having a first end movable with the valve member of the needle control valve and a second end positioned to move the valve member of the intensifier control valve only in the second position of the piezo electrical actuator.

9. A method of operating a fuel injector of a fuel system, comprising:

injecting fuel at an unintensified pressure level, at least in part, by: energizing a piezo electrical actuator at a low voltage level, moving the piezo electrical actuator to an intermediate position, moving a valve member of a needle control valve out of contact with a valve seat of the needle control valve, and maintaining a valve member of an intensifier control valve in contact with a valve seat of the intensifier control valve; and injecting fuel at an intensified pressure level, at least in part, by: energizing the piezo electrical actuator at a high voltage level, moving the piezo electrical actuator to a second position, moving the valve member of the needle control valve out of contact with the valve seat of the needle control valve, and moving the valve member of the intensifier control valve out of contact with the valve seat of the intensifier control valve.

10. The method of claim 9, wherein the steps of injecting fuel at the unintensified pressure level and injecting fuel at the intensified pressure level further include pushing an upper surface of a shared bridge with the piezo electrical actuator.

11. The method of claim 10, wherein the steps of injecting fuel at the unintensified pressure level and injecting fuel at the intensified pressure level further include pushing the valve member of the needle control valve against a first spring with a first end of a lower surface of the shared bridge.

12. The method of claim 11, wherein the step of injecting fuel at the intensified pressure level further includes pushing the valve member of the intensifier control valve against a second spring with a second end of the lower surface of the shared bridge, the second spring having a greater pre-load than the first spring.

13. The method of claim 9, wherein the steps of injecting fuel at the unintensified pressure level and injecting fuel at the intensified pressure level further include pushing the valve member of the needle control valve a first distance with the piezo electrical actuator.

14. The method of claim 13, wherein the step of injecting fuel at the intensified pressure level further includes:

pushing the valve member of the needle control valve a second distance with the piezo electrical actuator, the second distance being greater than the first distance;

pushing the valve member of the intensifier control valve with a second end of a connecting rod, the connecting rod having a first end movably connected with the valve member of the needle control valve.

15. The method of claim 9, further including:

de-energizing the piezo electrical actuator after the step of injecting fuel at the intensified pressure level;

moving the piezo electrical actuator to a first position;

moving the valve member of the needle control valve into contact with the valve seat of the needle control valve; and moving the valve member of the intensifier control valve into contact with the valve seat of the intensifier control valve.

16. The method of claim 15, further including refilling an intensifier control chamber, which is fluidly connected to the intensifier control valve, via an internal passageway of an intensifier piston.

17. A fuel injector for a fuel system, comprising:

a fuel injector body, housing:

an intensifier control valve for controlling movement of an intensifier piston;

a needle control valve for controlling movement of a needle valve member; and exactly one electrical actuator coupled with the intensifier control valve and the needle control valve via a coupling linkage;

each of the intensifier control valve and the needle control valve including a valve member that is movable with respect to a valve seat;

the electrical actuator having an intermediate position during which the valve member of one of the intensifier control valve and the needle control valve is in contact with the respective valve seat, and the valve member of an other of the intensifier control valve and the needle control valve is out of contact with the respective valve seat.

18. The fuel injector of claim 17, wherein the electrical actuator further includes a first position during which the valve member of the intensifier control valve is in contact with the valve seat of the intensifier control valve, and the valve member of the needle control valve is in contact with the valve seat of the needle control valve.

19. The fuel injector of claim 18, wherein the electrical actuator further includes a second position during which the valve member of the intensifier control valve is out of contact with the valve seat of the intensifier control valve, and the valve member of the needle control valve is out of contact with the valve seat of the needle control valve.

20. The fuel injector of claim 19, wherein, in the intermediate position of the electrical actuator, the valve member of the needle control valve is out of contact with the valve seat of the needle control valve, and the valve member of the intensifier control valve is in contact with the valve seat of the intensifier control valve.

* * * * *